United States Patent [19]

Seidler

[11] Patent Number: 4,747,794

[45] Date of Patent: May 31, 1988

[54] ELECTRICAL CONNECTOR

[75] Inventor: Jack Seidler, Flushing, N.Y.

[73] Assignee: North American Specialties Corp., College Point, N.Y.

[21] Appl. No.: 656,137

[22] Filed: Sep. 28, 1984

[51] Int. Cl.[4] ..... H01R 13/05

[52] U.S. Cl. ..... 439/857; 439/295; 439/849; 439/858; 439/862; 439/886

[58] Field of Search ..... 339/17 L, 176 MP, 252 R, 339/278 C, 47, 49

[56] References Cited

U.S. PATENT DOCUMENTS

| | | | |
|---|---|---|---|
| 2,744,244 | 5/1956 | Schumacher et al. | 339/47 R |
| 3,008,113 | 11/1961 | Johnson | 339/176 MP |
| 3,140,907 | 7/1964 | Davis | 339/17 L |
| 3,173,737 | 3/1965 | Kinkaid et al. | 339/176 MP |
| 3,218,599 | 11/1965 | Winkler | 339/47 R |
| 3,585,573 | 6/1971 | Robshaw | 339/278 C |
| 3,858,957 | 1/1975 | Harwood et al. | 339/176 MP |
| 3,970,353 | 7/1976 | Kaufman | 339/176 MP |
| 4,018,495 | 4/1977 | Freitag | 339/17 L |
| 4,168,879 | 9/1979 | Ohtsuki et al. | 339/176 MP |

FOREIGN PATENT DOCUMENTS 3242635 9/1983 Fed. Rep. of Germany .

*Primary Examiner*—Joseph H. McGlynn
*Attorney, Agent, or Firm*—Darby & Darby

[57] ABSTRACT

An electrical connector includes two assemblies which are adapted to mate. Each assembly has a number of contacts mounted thereon. The respective contacts (which may be pins and resilient tongues, or hermaphroditic contacts) include separate bearing surfaces and electrical contacting portions. The bearing surfaces of the contacts are subject to the abrasive action when the connector assemblies are being coupled or uncoupled, while the electrical contacting portions are protected from abrasion and contact one another only when the two assemblies are substantially coupled together.

12 Claims, 3 Drawing Sheets

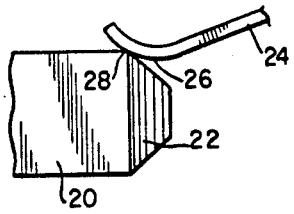
FIG. 1
PRIOR ART
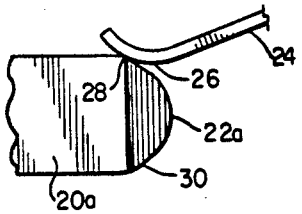
FIG. 2
PRIOR ART
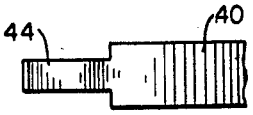
FIG. 4
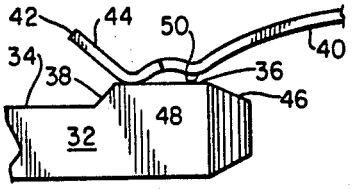
FIG. 3
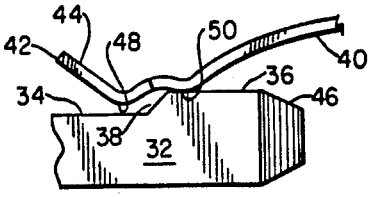
FIG. 5
FIG. 8
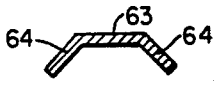
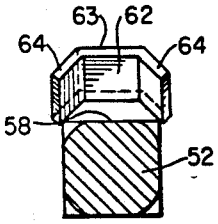
FIG. 7
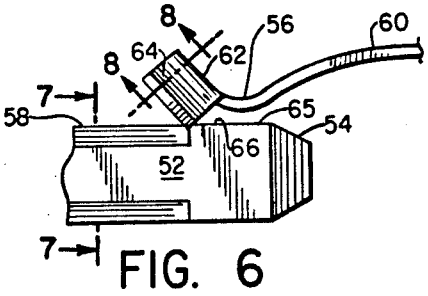
FIG. 6

ELECTRICAL CONNECTOR

BACKGROUND OF THE INVENTION

1. Field of the Invention

This invention relates to electrical connectors, and more particularly relates to improvements in the design of contacts for use in electrical connectors.

2. Description of the Prior Art

Many electrical connectors currently on the market include a pair of assemblies which cooperatingly mate to provide an electrical conductive path through the connector. One assembly of the connector may include one or a number of conductive pins or posts (generally called pins). Each pin is mounted at one end in the assembly (generally called a plug or pin connector) in a variety of different ways; the other end of each post is free standing. The other assembly of the connector includes one or a number of conductive resilient arms or leaves (generally called contacts), each contact corresponding to a pin of the pin assembly. The resilient contacts also are mounted in their receptacle assembly with one end of each contact free.

The pins and resilient contacts of the two assemblies are aligned so that, when the two assemblies of the connector are coupled together, each pin engagingly contacts the corresponding resilient contact.

Each resilient contact is biased by its resilience to assert sufficient contact pressure on the outer surface of its mating pin. Typically, the contacts are positioned in their rest state to extend partially into the axial path of the pins when the two connector assemblies are aligned but not yet coupled. The pins deflect the resilient contacts as the two connector assemblies are joined together, so that the resilience of the contact presses it against the mating pin post. This ensures a proper electrical path through the mating contacts of each connector assembly.

One of the problems with the conventional connectors having the structure described above is that their useful life is limited in number of connecting and disconnecting operations due to premature contact wear. This problem has especially manifested itself in applications where gold, platinum, iridium, rhodium or other noble or precious metals are suitably placed or coated (as by plating, rolling, filling, layering or the like) on electrical contact-making surfaces of the pins and resilient contacts, in order to make the connector more immune to corrosion and other environmental conditions and to reduce the electrical resistance of the pin-to-contact connection. The coated contact surfaces of the pins and resilient contacts may eventually be abraded by the sliding engagement of the contacts, and worn away as the connector is repeatedly connected and disconnected. This leaves the untreated under-material of the contacts exposed, so that they may corrode and result in an impaired conductive path through the connector, rendering the connector unacceptable for use after a shorter-than-desired connect/disconnect cycle life.

One way to extend this cycle life is to use a thicker layer of noble metal. However, this is undesirable because of the consequent substantial increase in material costs.

OBJECTS AND SUMMARY OF THE INVENTION

It is an overall object of the present invention to provide a connector which has an extended connect-/disconnect cycle life, for a given noble metal coating, and permitting substantial cost saving by reducing the noble metal material required for a given cycle life.

It is a more specific object of the present invention to provide an improvement in the design of contacts for an electrical connector, permitting the contacts to have coated contact-making portions which are not worn away by repeatedly connecting and disconnecting the mating assemblies of the connector.

It is another object of the present invention to provide such a connector which can be cost-effectively manufactured by conventional means.

The objects of the present invention are met by following two basic concepts in the design of the mating contacts of the connector. First, the connection-making surfaces connection-making of the contacts which are in contact when the mating connector portions are coupled together (which are usually coated with noble metal) are separated from the surfaces which rub over one another as the connector assemblies are being connected or disconnected. Second, the mechanical action of the contact is separated from its electrical action.

In accordance with the present invention, an electrical connector includes two assemblies which are adapted to mate cooperatively. Each assembly includes a housing mounting one or a number of electrical contacts.

The contacts of one assembly may be in the form of substantially rigid pins, which may be mounted in a housing. The contacts of the other assembly are then formed by resilient leaves or tongues, which also may be mounted in an appropriate housing. Where desired, both sets of contacts may be in the form of resilient tongues urged toward one another when coupled.

The contacts of one assembly are designed to be aligned with corresponding contacts of the other assembly so that when the two connector assemblies are coupled together, the contacts engage one another and provide an electrical path through the connector.

Each of the mating contacts include a rubbing or bearing section and an electrical contacting portion. These are so situated that the bearing sections of a mating pair of contacts, but not their electrical contacting portion, come in contact when the connector is actually in the process of being connected or disconnected. Only when the connector assembly has been substantially fully coupled together do the electrical contacting portions of each mating pair of contacts engage one another.

Thus, it can be seen that the bearing portions of the contacts protect the electrical contacting portions from undue wear and abrasion which might be caused by the repeated connecting and disconnecting of the connector.

It is envisioned to be within the scope of this invention that the contacts of each connector assembly can take on various shapes and sizes. Also, the bearing portion and electrical contacting portion of each contact may be situated in various positions on the contact so that they cooperatively engage the corresponding bearing portion and electrical contacting portion of a mating contact.

A preferred form of contact, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 1 is a fragmentary side elevation view of a pair of conventional contacts.

FIG. 2 is a fragmentary side elevation view of a pair of conventional contacts similar in many respects to those illustrated in FIG. 1.

FIG. 3 is a fragmentary side elevation view of an electrical connector in accordance with one embodiment of the present invention, at a position during engagement of the contacts.

FIG. 4 is a fragmentary plan view of one of the contacts illustrated in FIG. 3.

FIG. 5 is a side elevation view of the contacts shown in FIG. 3, illustrating the interaction of the contacts at final engagement in accordance with the present invention.

FIG. 6 is a fragmentary side elevation view of a pair of electrical contacts formed in accordance with a second embodiment of the present invention, the contacts being only partially engaged.

FIG. 7 is a sectional view of the embodiment shown in FIG. 5 viewed along line 7—7 of FIG. 5.

FIG. 8 is a sectional view of one of the contacts illustrated in FIG. 6, taken along line 8—8.

DETAILED DESCRIPTION OF THE PREFERRED EMBODIMENT

Figure 10:
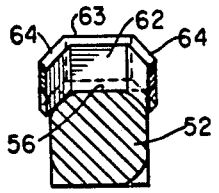
FIG. 10 is a sectional view of the embodiment shown in FIG. 9 taken along line 10—10 of FIG. 9.

A conventional pair of contacts for use in an electrical connector is illustrated in FIGS. 1 and 2. A typical connector includes a first assembly and a second assembly which are adapted to be coupled together. The first assembly includes one or a number of pins (one being shown at 20) which are usually mounted on or in an insulating housing and project outwardly to expose a free-standing end 22.

The second assembly includes one or a number of resilient contacts in the form of flat leaves or tongues (one being shown at 24) usually mounted on or in an insulating housing. The resilient contacts 24 may extend outwardly from the housing of the connector or be contained in it, so that one end of each resilient contact is at or faces an open end of the housing, and is free to move transversely.

It should be noted that the resilient leaf 24 extends into the axial path of the pin 20 so that the pin 20 deflects the resilient tongue 24 when the two assemblies of the connector are coupled together. This insures that the resilient contact and the pin remain in contact with each other to provide an electrical path through the connector.

As explained previously in this description, one of the disadvantages of the arrangement shown in FIG. 1 is that the bottom or contacting surface 26 of the resilient contact 24 and the top or contacting surface 28 of the pin 20 rub on one another as the pin and contact are mated, so that they may be unduly worn as their surfaces slide against one another whenever the connector assemblies are joined or uncoupled. This wearing action is exacerbated by the pressure exerted between the pin 20 and contact 24 because of the resilience of contact 24, necessary to maintain good electrical connection after full engagement. This mechanical sliding action can abraid the surfaces of the pin and resilient contact including the surfaces which abut when the assemblies are fully engaged. These surfaces are usually coated in known manner with a thin layer of a noble metal (e.g., gold, rhodium, iridium, platinum, etc.) to prevent corrosion and to provide good electrical interconnection. Because of the expense of these noble metal materials, only an exceedingly thin layer is used. However, the abrasive action just described wears away the noble metal, to a point where the effectiveness of the connector is impaired. The connect/disconnect cycle life of the connector is determined primarily by the wearing away of the noble metal coating. Thus, after the connector has been repeatedly disconnected and reconnected a number of time, it may become ineffective and have to be replaced.

This is a common occurrence when the pin 20, as illustrated in FIG. 1, has a sharp transition 28 between the shank 20 and the beveled surface of the tip 22. This sharp transition or edge can quickly abraid the coated surfaces of the resilient contact.

One way of partially dealing with this problem is illustrated in the embodiment of FIG. 2. The pin **20*a* is formed with a rounded continuous transition 30 between the shank and the tip 22*a*. Thus, in this form, there is no sharp edge on the pin 20*a* to scrape the surface of the resilient contact 24**. However, this modification of the pin still results in undesirable abrasion of the surfaces of the pin and resilient contact, leading to premature termination of useful life of the connector.

These disadvantages have been overcome by the design of the present invention. According to the invention, the connector includes mating contacts, with each contact having a rubbing or bearing portion and an electrical contacting portion separated from the bearing portion. The bearing portion takes up the abrasion resulting from the repeated coupling and uncoupling of the connector assemblies. The electrical contacting portions of each mating pair of contacts are prevented by the bearing portion from contacting either the bearing portion or the electrical contacting portion of a mating contact, until the two assemblies of the connector are substantially fully coupled together, whereupon the electrical contacting portions engage each other resiliently to provide an electrical path through the connector. Thus, the surfaces of the electrical contacting portions of the contacts are not worn away by the mechanical action of connecting or disconnecting the connector.

Referring now to the embodiment shown in FIGS. 3–5 of the drawings, it will be seen that the electrical connector in accordance with this embodiment of the present invention includes a first assembly and a second assembly, each having mounted thereon at least one electrically conductive contact. The first assembly includes a number of pins 32. Each pin 32 is shown as having a square cross-sectional shape, although the present invention will apply equally as well with a pin having a round or other cross-sectional shape. Each pin 32 is formed with a recessed surface on one side thereof to define a depression 34 where the pin has a reduced dimension. The outer surface 36 of the pin 32 may descend abruptly into this recess 34, or more preferably, may be joined with the recess 34 surface through a sloped portion 38. The recess 34 of the pin 32 is formed on the shank of the pin, as shown, and spaced inwardly from the tip. The recess 34 may extend completely to the base of pin 32 (not shown) or only partially.

The second connector assembly includes a number of resilient contacts or tongues, one being shown at 40. Each resilient tongue 40 includes a free end 42 which projects into the axial path of a corresponding pin 32 of the first assembly. The end 44 of resilient contact 40 is sloped generally as shown and engages a tapered portion 46 of pin 32. By a type of camming action, as the pin 32 is inserted into the resilient contact assembly, the resilient contact 40 is displaced upward, in cantilever fashion, against it resilient force, to create a pressure between pin 32 and the resilient contact 40. In this way, each pin 32 will engage and deflect the mating resilient tongue 40 to ensure positive contact between the two when the connector assemblies are coupled together.

The resilient contact 40 is formed with a pair of ridges or wavy crests 48, 50 on its bottom or contacting surface. These may be formed by conventional means, such as precision progressive stamping, to form the downwardly extending wavy crests acting as ridges. The first ridge or crest 48, located nearest the tip 44 of the resilient contact 40, acts as a rubbing or bearing surface to protect the second ridge 50, which is positioned more inwardly from the end 44 of the resilient contact 40.

Because the end 44 of the resilient contact 40 extends into the axial path of the pin 32, when engaging the connector assemblies, the tapered end 46 of pin 32 will first engage the sloped end 44 of contact 40, causing contract 40 to bend in cantilever fashion, until the first crest 48 bears on the top surface 36 of pin 32. Upon further engagement, the first ridge 48 will ride up on the tapered tip of the pin 32 and slide along the outer surface 36 of the pin 32. The second crest or ridge 50, which is further up on the resilient contact, remains off the surface 36 of the pin 32 during this engagement. Thus, all of the rubbing and abrasion will occur between the bearing surface of the first ridge 48 and the top surface 36 of pin 32.

As shown in FIG. 5, the pin 32 and the mating resilient contact 40 are designed so that the first ridge 48 is received in the depression 34 of the pin 32 when the two contacts or assemblies are fully engaged. The depth of the depression 34 is chosen so that before the first ridge 48 touches the pin surface in the depression 48, the second ridge 50 will contact the surface 36 of the pin 32. Thus, as the first ridge 48 falls into the depression 34, the second ridge 50 drops down to contact the outer surface 36 of the pin 32 without sliding along the outer surface 36. The second ridge portion 50 therefore serves as the electrical contacting portion of contact 40. However, the surface of the resilient contact 40 located at the second ridge 50 experiences no wear such as is normally associated with the coupling and uncoupling of the connector assemblies. Hence, this electrical contacting portion 50 may be coated with precious or noble metal without being subject to undesired abrasion. For economy, the remainder of contact 40 need not be so coated. Also, only the portion of the pin 32 opposite the ridge 50, when fully engaged, need be coated, and the remaining portion of the pin shank need not be, resulting in further economy.

In the embodiment just described, the contact 40 is a thin strip of resilient conductive material, such as phosphor bronze, longitudinally rectangular in shape. The first and second ridges 48,50 may extend across the entire width of the strip forming the contact 40. It will be understood that the coating of but a small portion of these contacts 32,40 may readily be accomplished by rolling a narrow ribbon of noble metal onto the contact blank (which may be of phosphor bronze) before forming the contacts, as in a multiple and progressive stamping operation, as is well known.

Although the coated surface located at second ridge 48 is protected from wear by the action of the first ridge 50, the outer surface 36 of the pin 32, which also acts as an electrical contacting surface, may be worn away by rubbing action of the first ridge 48.

To avoid this, it is preferred that the resilient contact 40 be formed in the shape shown in plan view in FIG. 4, having the camming end portion 44, including the first ridge 48, and narrower than the remaining portion of the resilient contact, including the second ridge 50 forming the electrical contacting surface.

A resilient contact with this configuration will only abraid a small center strip on the outer surface 36 of the pin 32; the rest of the outer surface 36 of the pin 32 will remain unaffected by the sliding action of the two mating contacts when the connector assemblies are being engaged. When the assemblies are fully engaged, the bottom surface of the second ridge 50 will rest on the unabraided portion of the outer surface 36 of the pin 32, to provide an effective long-life electrical path through the connector.

Although it is illustrated in FIG. 4 that the portion 44,48 of the resilient contact 40 is narrower in width than the portion which includes the second electrical contacting ridge 50, as an alternative the tip of the resilient contact 40 may be formed with a fork-like shape. With such a configuration, only the edge portions of the outer surface 36 of the pin 32 will be subject to wear; the central portion will remain unmarked and provide a good electrical contacting surface for the corresponding area of the resilient contact at the second ridge 50.

A second embodiment according to the present invention is illustrated in FIGS. 6–10. A square pin 52 has its edges tapered or bevelled or chamfered over a portion thereof spaced from the tip. Although in FIG. 6 all four edges can be thus chamfered, to faciliate manufacturing the pin it is desirable that only two adjacent corners be so formed, as illustrated in FIGS. 6–9.

The resilient mating contact 60 extends into the axial path of the pin 52 as before. It includes a leading portion 62 at its free end which is concavely curved or bent downwardly in the direction of the pin (or has a segmented concave shape as illustrated in FIG. 8) to form two legs or depending edges 64. The leading portion 62 is sloped upwardly to serve as a camming surface in conjunction with the tapered tip 54 of pin 52, in a manner similar to contact end 44 and pin taper 46 of FIG. 3.

The resilient contact 60 further includes a curved portion 56 joining the main body of the resilient contact 60 and the leading portion 62. The curved portion 56 extends downwardly, with the lowest point of the legs 64 of the leading portion 62 beyond the main body portion in the direction of the pin 52.

The legs 64 of the leading portion 62 of the resilient contact preferably form an obtuse angle with its mid section 63, the angle being about 135° so as to be nearly parallel to the bevelled section of pin 52 when fully engaged. These legs 64 are separated at a distance which is sufficient to allow the leading portion 62 to ride on the unchamfered portion 66 of the pin 52, with the edges of the legs 64 in contact with the surface of pin 52 at its corners.

As illustrated in FIGS. 6 and 7, when the two connector assemblies are being coupled together, the edges of legs 64 of the leading portion 62 of the resilient contact 60 slide along the pin surface at its corners and form bearing surfaces. This keeps the curved portion 56 raised above the flat surface 65 of the pin 52. This prevents abrasive wear of the surface of the resilient contact in the area of the curved portion 56, and of the flat surface 65 of the pin 52 in the region 66 between the chamfered portion 58 and the tip 54.

Figure 9:
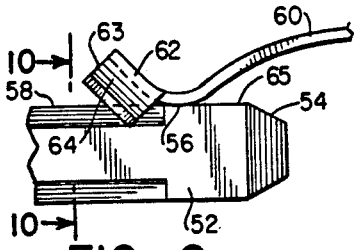
FIG. 9 is a side elevation view of the embodiment shown in FIG. 6, further illustrating the interaction of the two contacts, when fully engaged.
Figure 11:
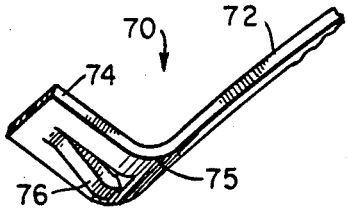
FIG. 11 is an isometric view illustrating the bottom of one of the contacts of a third embodiment in accordance with the present invention.

When the two connector assemblies have been fully engaged, the leading portion 52 of the resilient contact 60 is now located over the chamfered portion 58 of the pin 52. Because the corners of the pin 52 are chamfered, the two legs 64 of the contact leading portion 62 are no longer supported by the corners of the pin 52. The resilience of the contact 60 causes the curved portion 56 (which was previously raised above the surface of the pin) to drop into contact with the pin between the chamfered portion 58 and the tip 54, as illustrated in FIG. 9.

This arrangment has the advantage that the bearing surface of the resilient member 60 is formed by the edges of the legs 64, which creates that a minimum area of rubbing between resilient member 60 and the cooperating bearing surface 66 of the pin member 52. Since the electrical contacting area of pin member 52 is on a portion of surface 66, this assures that a minimal portion of the pin contacting area will be abraided.

If desired, the mating of the contact members may be set so that on full engagement, the resilient member electrical contacting area is in contact with the flat portion of the pin chamfered section 58, which then is made the electrical contacting area of the pin.

Thus, the embodiment described above provides good electrical contacting surfaces on both the pin and resilient contact which are not worn or abraided by repeated coupling and uncoupling of the connector assemblies.

In this embodiment, it will be advantageous to coat with noble metal only the portion of the pin which is located between the chamfered portion 58 and the tip of the pin, and the area of the resilient contact at the curved portion 56. Economy is achieved by not coating the chamfered portion of the pin or the leading portion of the resilient contact, which are areas not relied upon to provide an electrical conductive path through the connector.

A further embodiment of the present invention is illustrated in FIGS. 11–14 of the drawings. Here, the resilient contact 70 has a main body portion 72 and an upturned leading portion 74 forming the free end of the resilient contact, joined to the main body portion 72 by a curved portion 75. The upturned leading portion 74 has a protruding center strip 76 (which may be stamped out from the leading portion 72) and which extends below the bottom surface of the resilient contact.

Figure 12:
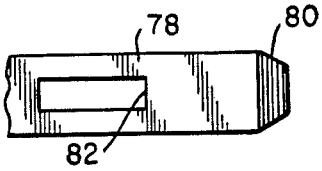
FIG. 12 is a plan view of another contact designed to mate with that illustrated in FIG. 11.

The mating pin 78 has a square cross-sectional shape, and has a tapered tip 80 which engages the center strip 76 when the connector is being coupled. The pin 78 is formed with a central opening in the form of a depression 82 located centrally in its top surface and spaced from the pin tip 80. Alternatively, as is illustrated in FIG. 12, the pin 78 may include a cental opening in the form of a hole extending entirely through its thickness and which is similarly spaced from the pin tip 80. The central opening 82 should have a depth and width of sufficient dimension to entirely receive the center strip 76 of the resilient contact 72.

Figure 13:
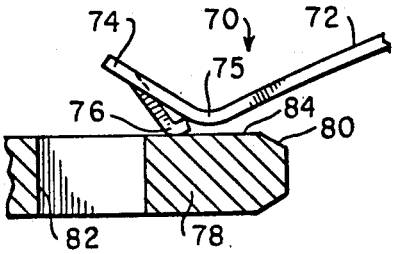
FIG. 13 is a side elevation view of the two contacts illustrated in FIGS. 11 and 12 and illustrating their interaction when partially engaged.
Figure 14:
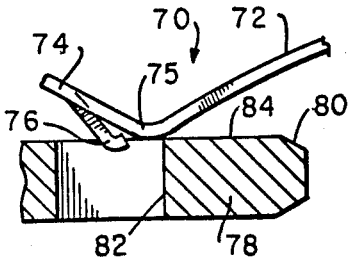
FIG. 14 is a side elevation view similar to that shown in FIG. 13 and further illustrating the interaction of the two contacts when fully engaged.

As illustrated in FIG. 13, as the two connector assemblies are being coupled together, the center strip 76 of the resilient contact 72 rides along the top surface 84 of the end portion of the pin 78. The center strip 76 thus acts to keep the curved portion 76 of the resilient contact 72 elevated from the surface of the pin 78.

When the two connector assemblies are about to become entirely engaged, the center strip 76 enters the central opening 82 formed in the pin 78. This permits the resilient contact 72 to drop toward the pin 78, with the curved portion 75 resting on the surface of the pin 78 on either side of the central opening 82. Because abrasion only occurs at the center strip 76 of the resilient contact and at a central portion of the end 84 of the pin 78, a good conductive path is provided between the curved portion 75 of the resilient contact and the top surface of the pin 78 on which the curved portion 75 rests.

As with the previous embodiments, only the electrical contacting portion of either contact need be coated with noble metal for extended life; that is, only the curved portion 75 of the resilient contact and the surfaces of the pin 78 on opposite sides of the central opening 82 need be so coated, again economizing on noble metal, which is shielded from abrasion by the configuration of the contacts.

The present invention is not restricted to connectors having a pin assembly and a resilient contact assembly, but is adaptable for use with hermaphroditic contact connectors, in which the contacts for both connector assemblies are the same. This is shown in the further embodiment of the present invention illustrated in FIGS. 15–17 of the drawings.

Figure 15:
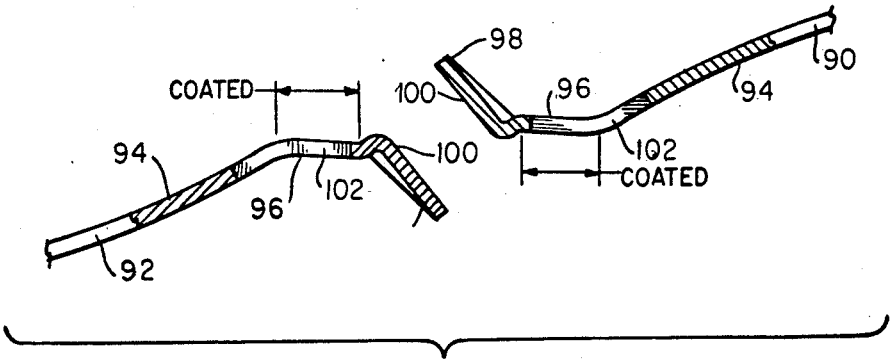
FIG. 15 is a side elevation view of a pair of mating hermophrodite contacts formed in accordance with a fourth embodiment of the present invention.

FIG. 15 shows a pair of mating hermaphroditic contacts 90,92 in accordance with present invention. Each contact has a free end extending from a respective connector assembly, which when mated cause the contacts to engage to complete an electrical path through the connector.

Each contact 90,92 includes a main body section 94 which may be mounted in the connector assembly, an intermediate section 96 obtusely angled from the main body portion 94, and a leading tip section 98 extending at an angle from the intermediate section 96. The tip section 96 includes a center strip 100 which projects outwardly from the surface of the tip section 98, in much the same way as the center strip 76 of the embodiment shown in FIG. 11.

The intermediate section 96 and a short part of the main body section 94 adjacent the intermediate section 96 include a central opening 102 formed through the thickness thereof, which is similar in many respects to the central opening 82 formed in the pin 78 illustrated in FIG. 13.

The actual electrical contacting surface is the portion of the intermediate section 96 on both sides of the central opening 102. When the two connector assemblies are being coupled together, the center strip 100 of one contact rides on the center strip 100 of the other, thereby keeping the electrical contacting surfaces separated.

Figure 17:
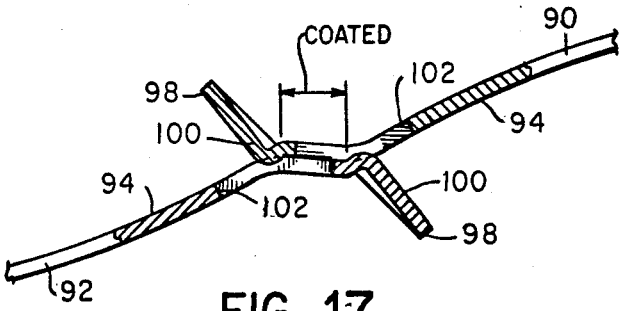
FIG. 17 is a side elevation view of the contacts illustrated in FIG. 15, further illustrating their interaction.

When the connector assemblies are fully engaged, as illustrated in FIG. 17, the center strips 100 are received in the openings 102 formed in the mating contact. When this occurs, the areas on each side of the central openings 102 of the intermediate section 96 contact each other substantially without any rubbing action, and provide a good electrical path through the connector while minimizing abrasion at the contacting areas.

It will be appreciated that variations may be made in the structure of the contacts described herein which provide an electrical contacting surface and a bearing surface which protects the electrical contacting surface when the connector assemblies are coupled and uncoupled. For example, instead of a single central opening 82 formed in the pin 78 as illustrated in FIG. 13, the lateral side walls of the pin may be cut away to provide a narrow central raised portion, and correspondingly, rather than provide a single center strip on the upturned portion of the resilient arm illustrated in FIG. 11, a pair of side by side strips may be provided on that portion. The strips of the resilient contact would then be received by the recesses formed in the sides of the pin to provide an electrical path through the surfaces of the pin and resilient contact residing between the recesses and lateral strips.

Figure 16:
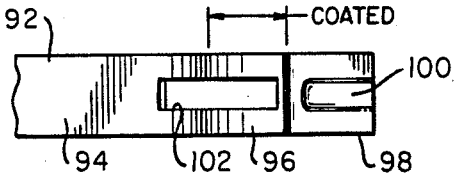
FIG. 16 is a plan view of one of the hermophrodite contacts illustrated in FIG. 15.

Likewise, with the embodiment illustrated in FIGS. 15–17, a pair of lateral strips may project from the tip portions of each contact to be received by side recesses or notches formed in the intermediate section of the other contact.

The electrical connector formed in accordance with the present invention avoids many of the drawbacks apparent with connectors currently on the market today. By separating the mechanical function of mating corresponding contacts (with good resiliency to hold them together) from the electrical function of providing a good electrical path through the contacts, an extended connect/disconnect cycle life can be achieved.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connector which comprises:

a pair of pin-and-socket type mating connector assemblies, each of which is adapted for sliding engagement with the other, to form an electrically conductive path from one assembly to the other;

one of said assemblies comprising a substantially rigid member, and the other of said assemblies comprising a resilient leaf member, each of the substantially rigid member and resilient leaf member having a free-standing end and each of the substantially rigid member and resilient leaf member being electrically conductive;

said substantially rigid member and resilient leaf member being positioned in their respective connector assemblies to have their free-standing ends contact each other upon the coupling of said connector assemblies thereby providing an electrically conductive path through the connector;

the resilient leaf member being biased toward the substantially rigid member so as to be adapted to slidably engage the substantially rigid member during the coupling and uncoupling of said connector assemblies;

said leaf member including a central bearing surface adjacent one end thereof which slides upon the other member during the coupling and uncoupling of the connector assemblies, and also including an electrical contacting surface area longitudinally spaced from said bearing surface;

said rigid member including an end having a central bearing surface and an electrical contacting surface area laterally displaced therefrom and adapted to cooperate with said leaf member contacting surface area;

the bearing surface of said leaf member being in the form of a protrusion adapted to cooperate with the bearing surface of said rigid member to maintain said electrical contacting surface areas separated during the coupling and uncoupling of the connector assemblies;

said rigid member including a reduced thickness portion dimensioned to receive said protrusion upon the substantially complete coupling of said connector assemblies to cause said electrical contacting surface areas of said members to engage each other to provide an electrically conductive path through the connector.

2. An electrical connector as in claim 1 wherein the resilient leaf member includes a center strip protruding from the bearing surface thereof and adapted to cooperate with the substantially rigid member bearing surface to prevent contact between the resilient member electrical contacting surface area and the substantially rigid member electrical contacting surface area and bearing surface and to prevent contact between the resilient member bearing surface and the substantially rigid member electrical contacting surface area, during the coupling and decoupling of the connector assemblies; and wherein the substantially rigid member has a central opening formed in the bearing surface thereof and extending through the thickness of the substantially rigid member, the opening being dimensioned to receive the resilient member center strip upon the substantially complete coupling of the connector assemblies to cause the electrical contacting surface areas of the resilient and substantially rigid members to engage each other to provide an electrically conductive path through the connector.

3. An electrical connector as in claim 1 wherein said protrusion is a first ridge extending from the resilient leaf member and forming its bearing surface; and said substantially rigid member has said reduced thickness adjacent its bearing surface.

4. An electrical connector as in claim 3, wherein said ridge is adapted to cooperate with the bearing surface of the substantially rigid member to prevent contact between the electrical contacting surface area of the resilient leaf member and the electrical contacting surface area and bearing surface of the substantially rigid member and to prevent contact between the substantially rigid member electrical contacting surface area and the resilient member bearing surface during the coupling and uncoupling of the connector assemblies, and wherein the substantially rigid member further includes a recessed portion formed at the bearing surface thereof to define a depression dimensioned to receive the first ridge of the resilient leaf member upon the substantially complete coupling of the connector assemblies to cause the electrical contacting surface areas of the resilient and substantially rigid members to engage each other to provide an electrically conductive path through the connector.

5. An electrical connector as defined in claim 3 wherein the resilient member further includes a second ridge protruding from the same side of said resilient member as its bearing surface, the second ridge being positioned at the electrical contacting surface area and spaced and dimensioned relative to the first ridge so as to remain out of contact with the substantially rigid member bearing surface and electrical contacting surface during the coupling and uncoupling of the connector assemblies and so as to engage the electrical contacting surface area of the substantially rigid member upon substantially complete coupling of the connector assemblies.

6. An electrical connector as defined in claim 3 wherein the resilient member is narrower in width over a poriton thereof which includes the bearing surface and the first ridge.

7. An electrical connector as defined in claim 4 wherein the substantially rigid member bearing surface is sloped adjacent the recessed portion.

8. A pin-and-socket type connector comprising a pair of electrically conductive contact emmbers, one contact member of said pair being resilient, and the other contact member of said pair being substantially rigid, each of said contact members having a free-standing end, said contact members being adapted to slidable engagement one with the other over their free-standing ends, with said resilient contact member resiliently urging said members toward one another during said engagement, each of said contact members having an electrical contacting area, means formed on said contact members for maintaining said electrical contacting areas out of contact with one another during the engaging of one contact member with the other until said engagement is substantially complete, an for causing said contact areas to be in electrical contact when said contact members are in substantially complete engagement, said means comprising a protrusion forming a first bearing surface on one of said contact members, a cooperating second bearing surface on the other of said contact members and in slidable resiliently urged contact with said first bearing surface during coupling of said contact members, said protrusion extending centrally and longitudinally out of said resilient member and forming its bearing surface, the bearing surface of one of said contact members being spaced from the electrical contacting area of said one contact member, so that said electrical contacting area is not subject to abrasion during coupling of said contact members, the bearing surfaces of the contact members being formed to maintain said electrical contacting areas spaced apart during coupling of said contact members, the bearing surface of the other contact member having a reduced dimension portion adpated to receive said protrusion upon substantially complete engagement of said contact members to cause said resilient contact member to urge its elecltrical contacting area into contact with the electrical contacting area of the substantailly rigid contact member.

9. An electrical connector as in claim 8 wherein said protrusion is a ridge extending transversely of said resilient contact member.

10. An electrical connector as in claim 8 wherein said protrusion is a bent narrow strip extending centrally and longitudinally from said resilient member, longitudinally spaced from its contact surface area, the bend of said strip forming its bearing surface.

11. An electrical connector as in claim 8 wherein the electrical contacting areas of each contact member are coated with a previous metal and whereby abrasion of the precious metal is minimized.

12. A pin-and-socket type electrical connector, which comprises:

a pair of mating connector assemblies, each of which is adapted for sliding engagement with the other, to form an electrically conductive path from one assembly to the other;

both of said assemblies including a resilient leaf member of substantially the same configuration, each resilient member being electricaly conductive, and each resilient member having a free-standing end;

the resilient leaf members being postioned in their respective connector assemblies to have their free-standing ends contact each other upon the coupling of said connector assemblies thereby providing an electrically conductive path through the connector from one resilient member to the other resilient member;

at least one of the resilient members being biased toward the other resilient member so as to be adapted to slidably engage the other resilient member during the coupling and uncoupling of the connector assemblies;

each of the resilient leaf members including a bearing surface upon which the bearing surace of the other resilient member slides during the coupling and uncoupling of the connector assemblies, and also including an electrical contacting surface area;

each resilient member including a central strip protruding from the bearing surface region thereof and adapted to cooperate with the central strip of the other resilient member to prevent contact between the electrical contacting surface area of one resilient member and the electrical contacting surface area of the other resilient member and to prevent contact between the bearing surface of each resilient member and the electrical contacting surface area of the other member, during the coupling and uncoupling of the connector assemblies;

each resilient member having a central opening formed therein, the opening being dimensioned to receive the central strip of the mating resilient member upon the substantially complete coupling of the connector assemblies to cause the electrical contacting surface areas of the resilient members to engage each other to provide an electrically conductive path through the connector.

* * * * *